US009409299B2

(12) United States Patent
Segler

(10) Patent No.: US 9,409,299 B2
(45) Date of Patent: Aug. 9, 2016

(54) KNIFE

(71) Applicant: Florian Segler, Solingen (DE)

(72) Inventor: Florian Segler, Solingen (DE)

(73) Assignee: MARTOR KG, Solingen (DE)

( * ) Notice: Subject to any disclaimer, the term of this patent is extended or adjusted under 35 U.S.C. 154(b) by 390 days.

(21) Appl. No.: 14/014,552

(22) Filed: Aug. 30, 2013

(65) Prior Publication Data

US 2014/0059864 A1 Mar. 6, 2014

(30) Foreign Application Priority Data

Sep. 4, 2012 (DE) ..... 10 2012 017 431

(51) Int. Cl.
*B26B 1/08* (2006.01)
*B26B 5/00* (2006.01)

(52) U.S. Cl.
CPC . *B26B 1/08* (2013.01); *B26B 5/002* (2013.01); *B26B 5/003* (2013.01)

(58) Field of Classification Search
CPC ..... B26B 5/001–5/003; B26B 1/08; A61B 2017/32113; A61B 2017/3213
USPC ..... 30/2, 162
See application file for complete search history.

(56) References Cited

U.S. PATENT DOCUMENTS 4,868,985 A * 9/1989 Rehm ..... B26B 5/003 30/162
5,531,754 A * 7/1996 Shackelford, Sr. A61B 17/3211 30/162
5,581,890 A 12/1996 Schmidt
6,226,873 B1 5/2001 Okumura
6,949,109 B2 * 9/2005 Iske ..... A61B 17/3211 30/162
7,101,382 B2 * 9/2006 George ..... A61B 17/3211 30/162
2003/0028973 A1 2/2003 Johnson et al.
2004/0111895 A1 * 6/2004 Huang ..... B26B 5/002 30/162
2004/0237312 A1 * 12/2004 Hernandez ..... B26B 5/003 30/162
2004/0250426 A1 * 12/2004 Polei ..... B26B 5/001 30/162
2005/0050734 A1 * 3/2005 Kesinger ..... B26B 5/002 30/162
2005/0150116 A1 7/2005 Johnson
2005/0193568 A1 * 9/2005 Peyrot ..... B26B 5/001 30/162
2006/0080842 A1 * 4/2006 Schmidt ..... B26B 5/001 30/162
2007/0119056 A1 * 5/2007 Polei ..... B26B 5/001 30/162

(Continued)

FOREIGN PATENT DOCUMENTS

CN 2495423 6/2002
WO 157262 A2 12/2011

*Primary Examiner* — Kenneth E Peterson
(74) *Attorney, Agent, or Firm* — Andrew Wilford

(57) ABSTRACT

The invention relates to a knife comprising a housing (11) and an actuator (14) that can shift a blade holder (13) carrying a blade (47) in the housing (11) between at least one safety position and at least one cutting position, the blade holder (13) being tensioned by a spring (35). The characterizing feature consists in the fact that the spring (35) is attached to the housing (11) and to a first entrainment formation (25), and that a second entrainment formation (46) is associated with the blade holder (13), which second entrainment formation can be releasably engaged with the first entrainment formation (25) such that the first entrainment formation (25) can be moved by the second entrainment formation (46) from the safety position to the cutting position by movement of the blade holder.

10 Claims, 6 Drawing Sheets

(56) References Cited

U.S. PATENT DOCUMENTS

2007/0277382 A1 12/2007 Okada
2008/0222897 A1* 9/2008 Marfione ..... B26B 1/08 30/162
2009/0106983 A1 4/2009 Berns
2009/0235534 A1* 9/2009 Chu ..... B26B 1/08 30/162
2009/0255128 A1* 10/2009 Parker ..... B26B 5/003 30/162
2011/0232104 A1* 9/2011 Ho ..... B26B 5/003 30/162
2011/0283542 A1* 11/2011 Wu ..... B26B 5/003 30/162
2011/0283543 A1* 11/2011 Wu ..... B26B 5/003 30/162
2011/0308092 A1* 12/2011 Lin ..... B26B 5/002 30/164
2012/0272529 A1* 11/2012 Constantine ..... B26B 1/08 30/162
2013/0199047 A1* 8/2013 Herlitz ..... B26B 5/001 30/162
2014/0053410 A1* 2/2014 Huang ..... B26B 1/08 30/162

* cited by examiner

KNIFE

FIELD OF THE INVENTION

The invention relates to a knife.

BACKGROUND OF THE INVENTION

A knife is well-known from published prior use. It comprises a housing in which a blade holder is located. The blade holder can be moved between a safety position and a cutting position. The blade is inaccessible in the housing when in the safety position, and projects from the housing when in the cutting position. A spring is fastened to the housing and to the blade holder, and urges the blade holder for example into the safety position.

The blade holder is often removed from the housing in order to change blades. As this is done, the spring is frequently overstretched and thus destroyed.

OBJECT OF THE INVENTION

The object of the invention is to create a knife that allows the blade to be conveniently changed while preventing any damage to the spring.

SUMMARY OF THE INVENTION

This object is achieved by a knife according to the invention that comprises a housing provided with a blade holder. The blade holder can be moved between at least one safety position in which a blade supported in the blade holder is inaccessible in the housing, and at least one cutting position in which the blade holder is in a position in which the blade projects from the housing. The blade holder is located, for example, inside the housing. It can be for example slidable on guide faces of the housing.

A spring is attached to the housing and to a first entrainment formation. The term spring according to the invention can include any form of biasing element, such as for example a metal spring, gas cylinder, etc. This can refer, for example to a tension spring or a compression spring. The spring can be loaded for example by moving the blade holder from the safety position into the cutting position. Alternatively or additionally, the spring can be loaded by moving the actuator or the actuating component from a first position into a second position. The first position is for example a rear position and the second position is for example a front position.

Actuator as defined by the invention in the broadest sense refers to a device for moving the blade holder. For example, an actuating handle can be part of the actuator. The actuator can for example comprise a motion-transmitting mechanism between the handle and the blade holder.

A second entrainment formation is associated with the blade holder or the actuator. The second entrainment formation is provided on or attached for example to the blade holder or the actuator, i.e. one part or more parts of the actuator. For example, the second entrainment formation is formed directly or indirectly on the blade holder or the actuator. The second entrainment formation can be moved in releasable contact with the first entrainment formation. The second entrainment formation is carried along whenever, for example the blade holder is moved from the safety position to the cutting position by moving the actuator from the unactuated position to the actuated position. The first entrainment formation is driven, for example by the second entrainment formation, and moved from the rear position to the front position, thereby tensioning the spring. The second entrainment formation that is in contact with the first entrainment formation is also loaded by the spring. If, for example the second entrainment formation is attached to the blade holder, the blade holder is forced by the spring, for example into the safety position. If the blade holder is fixed or coupled to the actuator, it is entrained thereby.

When a blade is changed, the blade holder can be removed, for example from the housing without the need for the spring to be disconnected, since the entrainment formations can be detached from each other. The blade holder is, for example removed from the housing together with the second entrainment formation, while the first entrainment formation remains in place in the housing with the spring.

In one embodiment, the first entrainment formation is associated with a slide that can shift between a rear position and a front position on a guide of the housing. The first entrainment formation is composed, for example of a pin. The pin projects, for example into the housing so as to enable it to come into contact with the second entrainment formation when moved from the rear position to the front position and carry this element along.

The guide of the slide comprises, for example a first guide on the housing and a second guide on the slide. The first guide is formed for example by a groove or a slot. The second guide is provided, for example by a guide structure of the slide.

The second guide is provided, for example by the first entrainment formation.

In one embodiment of the invention, the blade is retained in a blade seat between a first support face of the blade holder and a second support face of a retaining element. The retaining element can be moved, for example between a retaining position and a release position. In the retaining position, the blade is retained by a nonpositive and/or positive clamp between the first supporting face and the second supporting face. When in the release position, the retaining element can be moved away from the blade holder, thereby enabling the blade to be removed from the blade seat.

Together with the blade holder, the retaining element creates, for example a pivot joint. The pivot joint can, for example be at a first end region of the blade holder and of the retaining element. The blade can be retained, for example in the blade seat at a second end region of the blade holder and of the retaining element.

The retaining element for example forms the actuator. The housing here is formed with a groove through which the retaining element passes. A ridge of the actuator, for example passes through the groove.

Unwanted movement of the retaining element from the retaining position to the release position can be prevented by an approach whereby the retaining element includes at least one arm that grips under the adjacent side wall of the housing. The retaining element is retained on the blade holder, for example by a pivot joint and additionally by the arm, the arm precluding any unwanted movement by the retaining element between the retaining position and the release position. The retaining element can then be moved into the release position, whenever the assembly unit consisting of the blade holder and actuator is removed from the housing.

BRIEF DESCRIPTION OF THE DRAWING

Additional advantages are described in the following with reference to an embodiment shown in the figures. Therein.

SPECIFIC DESCRIPTION OF THE INVENTION

Figure 1:
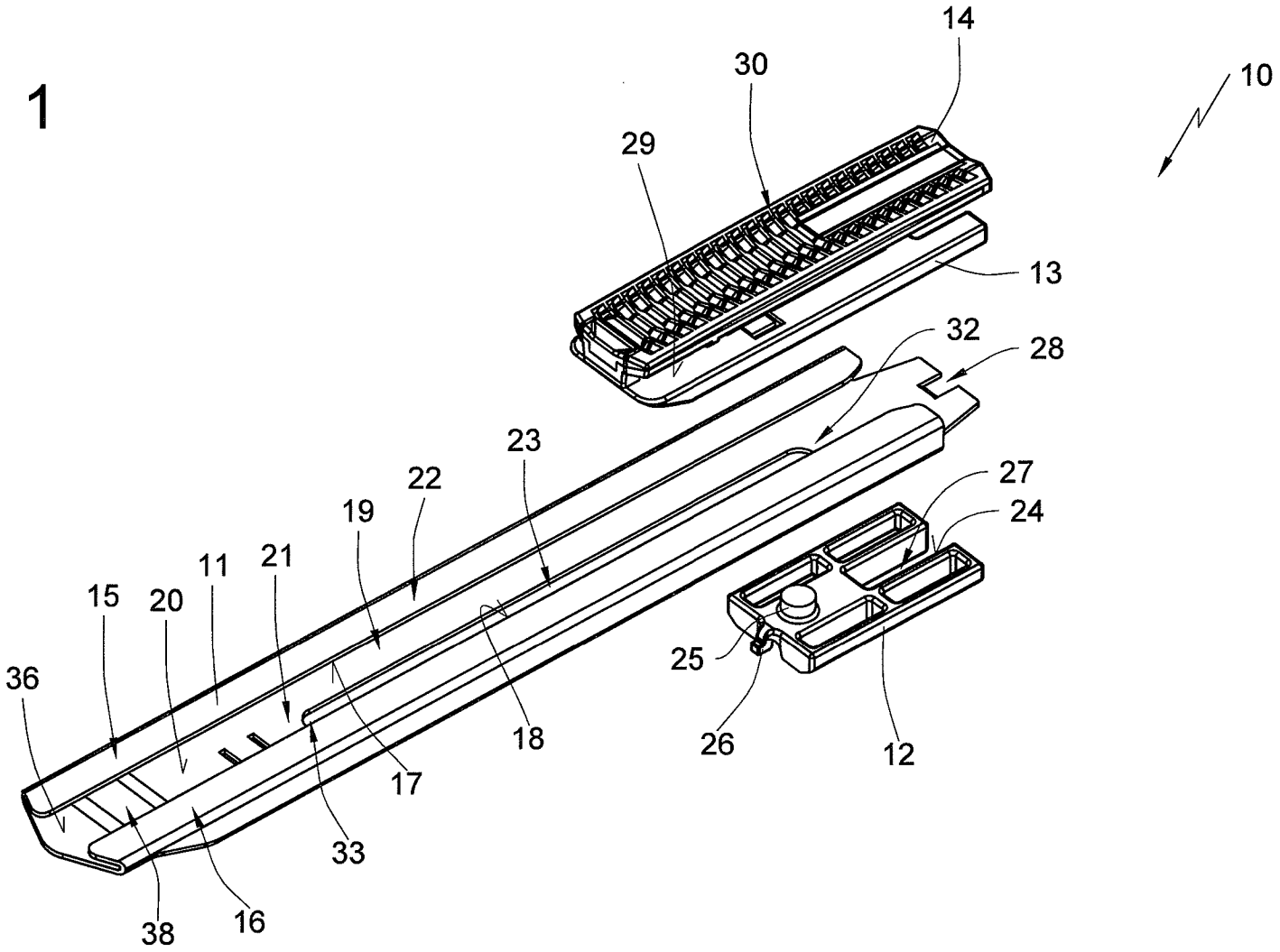
FIG. 1 is an exploded view of the knife comprising a housing, a spring slide, a blade holder, and an actuator.

The knife as a whole is identified at 10 in the figures. Identical reference numerals in the various figures identify corresponding parts, including where lower-case letters have been added or omitted.

FIG. 1 shows that the knife 10 comprises a housing 11, a spring slide 12, a blade holder 13, and also an actuator 14.

The housing 11 in this embodiment is made of sheet metal. Side flaps 15 and 16 are provided on the housing 11 that are folded over such that edges 17 and 15 of these flaps point toward each other and create guide surfaces. A groove 19 is formed between the edges 17 and 18. A floor surface 20 is formed by a floor wall 21 of the housing 11. The floor wall 21 is located opposite a top wall 22 formed by the side flaps 15 and 16. A blade 47 not shown in FIG. 1 is located between the floor surface 20 and the side flaps 15 and 16. A slot 23 is formed in the floor wall 21. A tongue 34 (FIGS. 7 and 8) is cut out of a rear end 28 of the housing 11 and is folded over. The tongue 34 is not shown in FIG. 1.

The spring slide 12 has a slide face 24. In addition, the spring slide 12 is formed with an entrainment pin 25 as well as a spring hook 26. The spring slide 12 is formed with a recess 27 on a side opposite the slide face 24.

The blade holder 13 has a face formed as a blade seat 29. The blade 47, which is not shown in FIG. 1, is retained between the blade holder 13 and the actuator 14. The actuator 14 is provided with ridges 30 that prevent the fingers of a user from sliding off.

Figure 2:
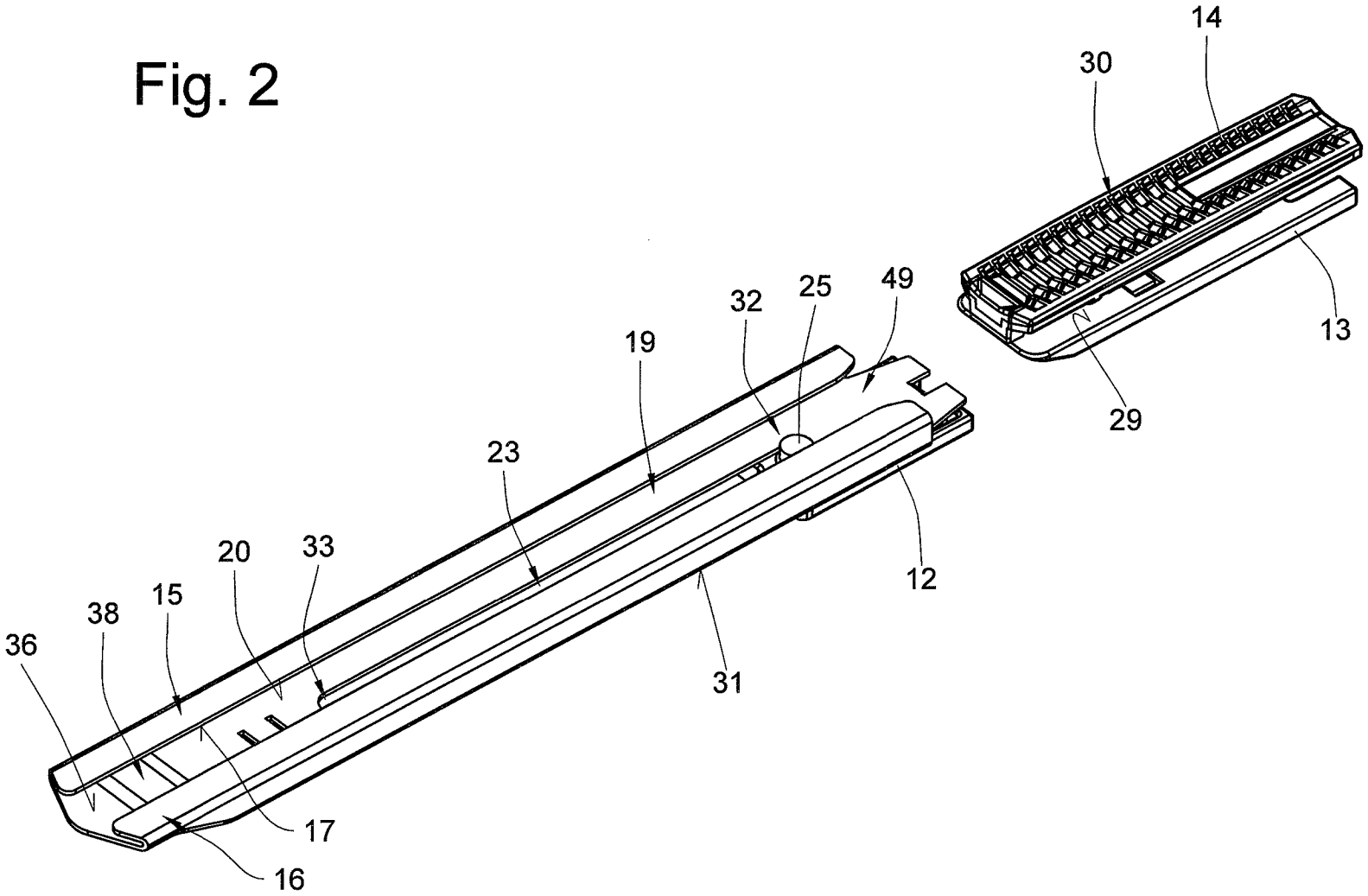
FIG. 2 is a detail from the exploded view of the knife with the spring slide installed on the housing.

FIG. 2 illustrates the spring slide 12 in the installed position. The slide face 24 rests against an outer face 31 of the floor wall 21. The entrainment pin 25 passes through the slot 23. This limits movement of the spring slide 12. In the rear position of FIG. 2, the entrainment pin 25 is at a rear end 32 of the slot 23. When in the front position, the entrainment pin 25 is at a front end 33 of the slot 23.

Figure 3:
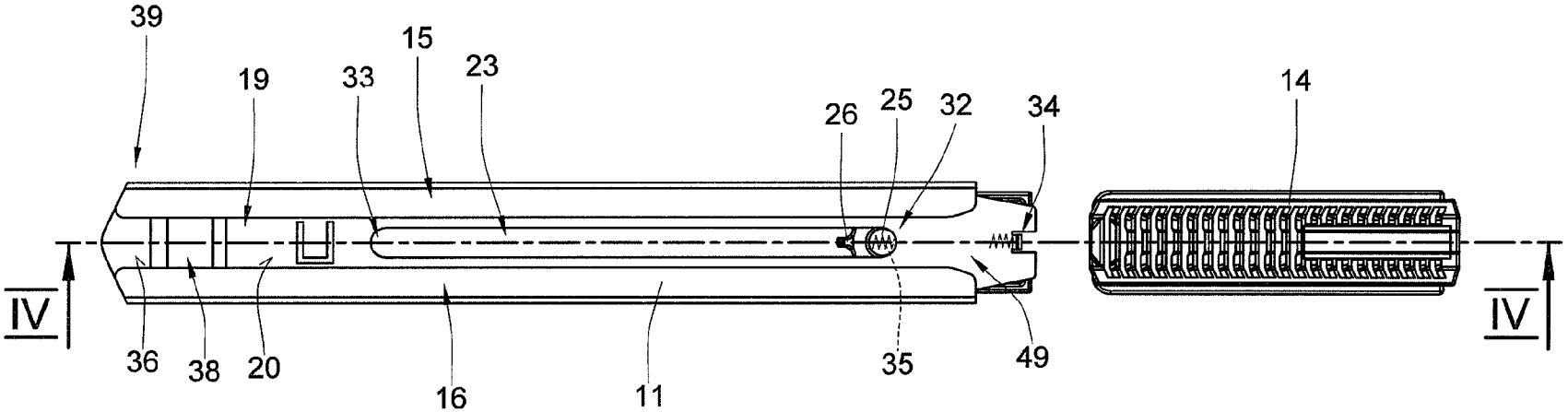
FIG. 3 is a top view of the knife with the blade holder and the actuator not installed.

FIG. 3 shows the tongue 34 at the rear end 28 of the housing 11. One end of a spring 35 is fastened to the tongue 34. Another end is retained on the spring hook 26 of the spring slide 12.

Figure 6:
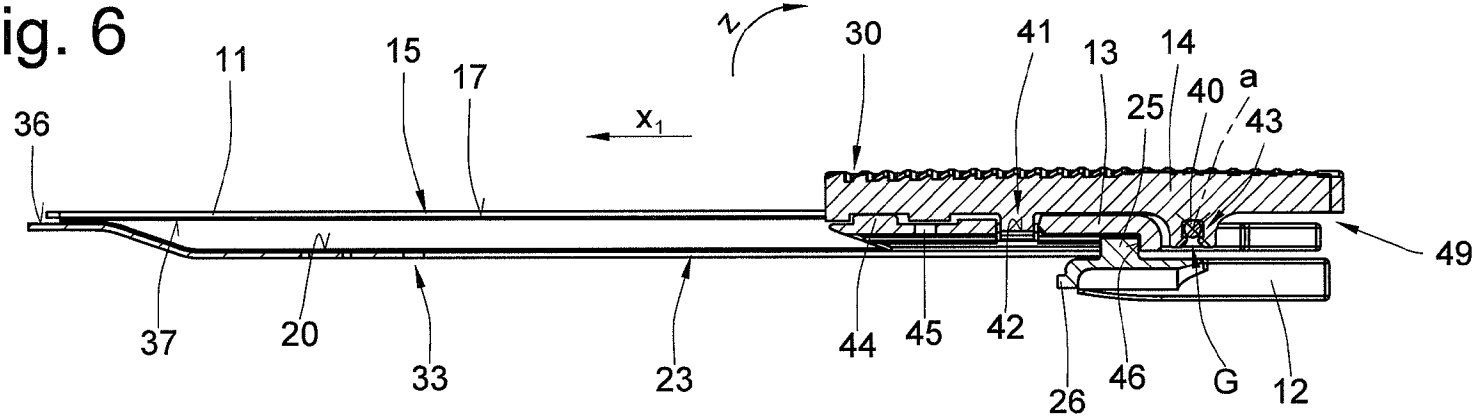
FIG. 6 is a section along line VI-VI in FIG. 5.
Figure 7:
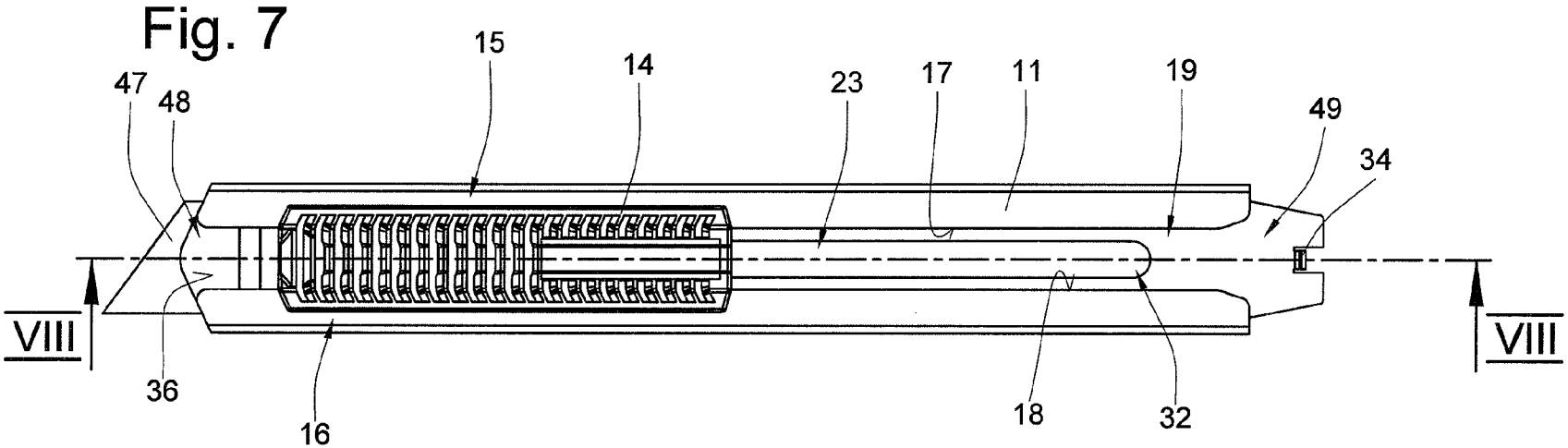
FIG. 7 is a top view of the knife as in FIG. 5 with the blade in the cutting position.

A front end 39 of the housing 11 includes a guide surface 36 that is joined to the floor by an angled wall region 38. The guide surface 36 is at a spacing from lower faces 37 of the side flaps 15 and 16 that is less than their spacing from the floor surface 20. The blade holder 13 and the blade 47 (not shown in FIG. 4) can thus be slid between the faces 37 and the floor surface 20 when shifting between the safety position (FIGS. 5 and 6) and the cutting position (FIGS. 6 and 7).

Figure 4:
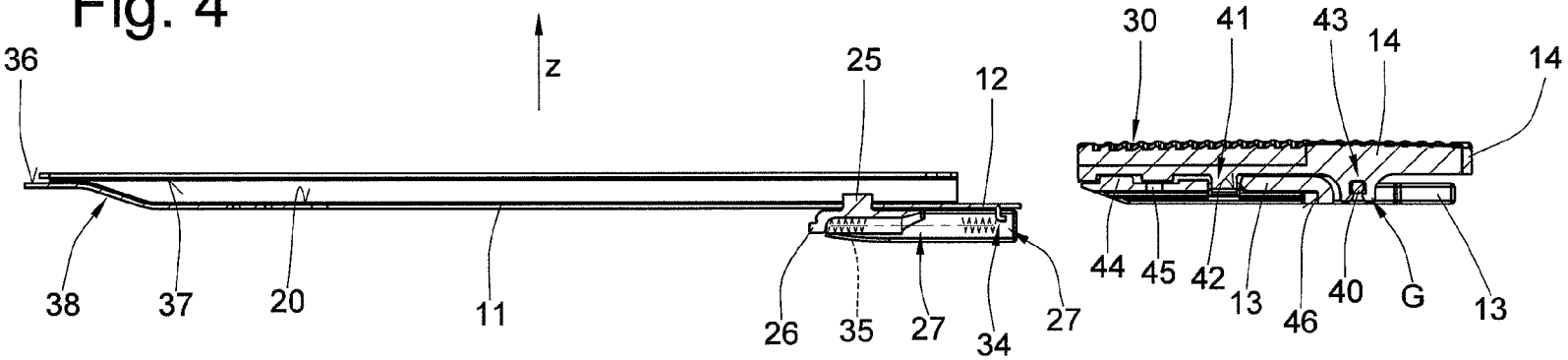
FIG. 4 is a section along line IV-IV in FIG. 3.

FIG. 4 shows that a pivot pin 40 is provided on the blade holder 13 that locks into a bearing seat 43 of the actuator 14. As a result, the blade holder 13 forms a pivot G with a pivot point a. Hook-shaped arms 41 including retaining faces 42 are provided on the actuator 14. When the blade holder 13 and the actuator 14 are installed, the arms 41 grip under the side flaps 15 and 16 so as to prevent the actuator from being pivoted in a direction z out of a retaining position into a release position.

The blade seat 29 comprises a stud 44 that passes through and fits with a correspondingly shaped hole in the blade 47 and thus retains the blade 47 in a positive-locking manner in the blade seat 29. In addition, the blade seat 29 is formed with a recess in which a magnet 45 is installed to make the blade 47 cling to the blade seat 29. The bottom of the blade holder 13 forms an entrainment face 46.

Figure 5:
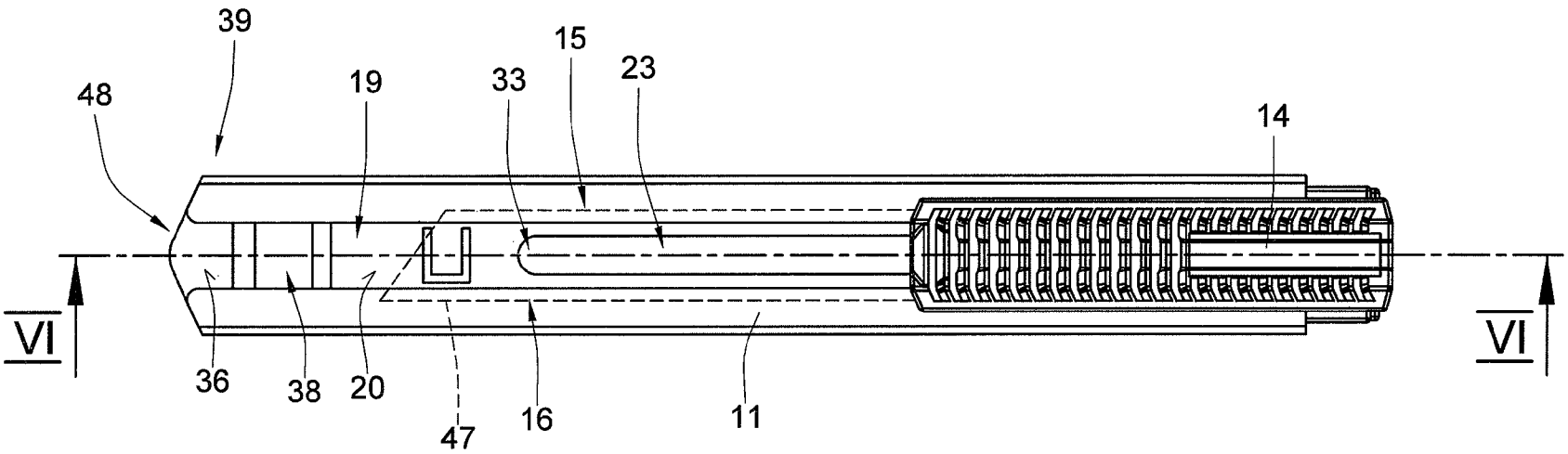
FIG. 5 is a top view of the knife with the blade holder and the actuator installed and the blade in the safety position.
Figure 8:
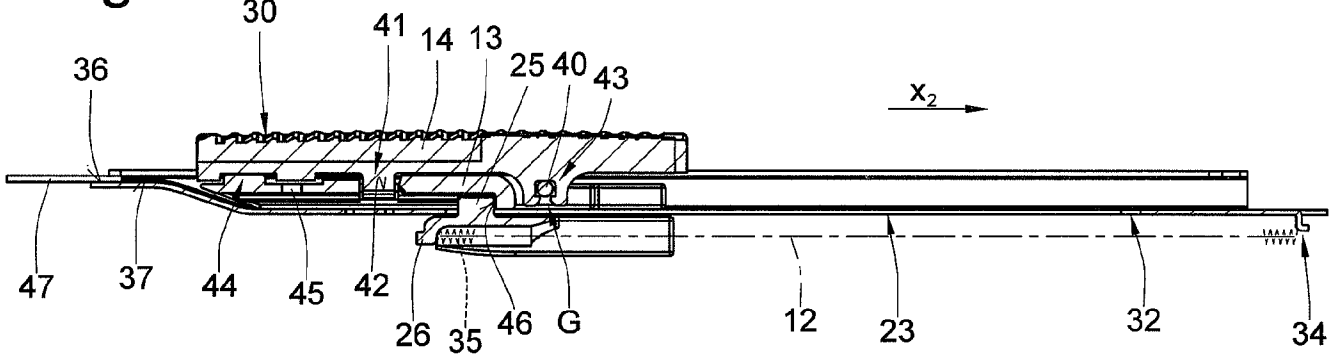
FIG. 8 is a section along line VIII-VIII in FIG. 7.
Figure 9:
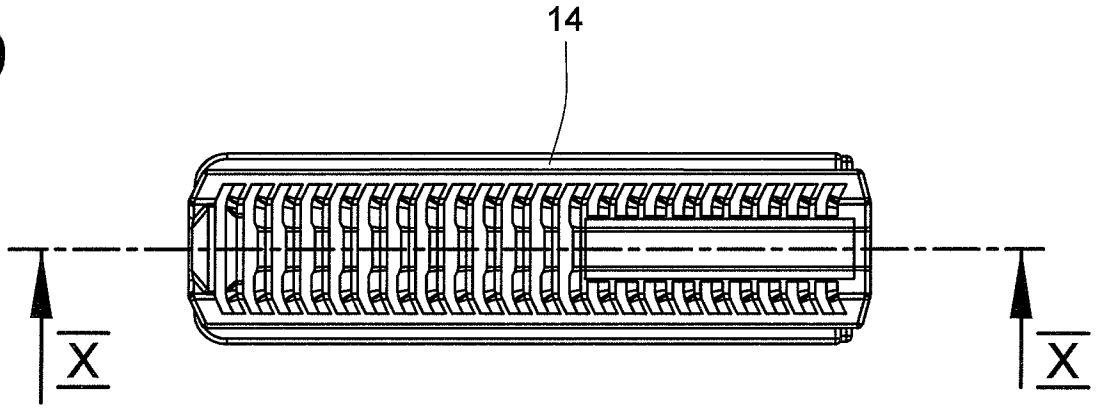
FIG. 9 is a schematic top view of the blade holder and actuator.
Figure 10:
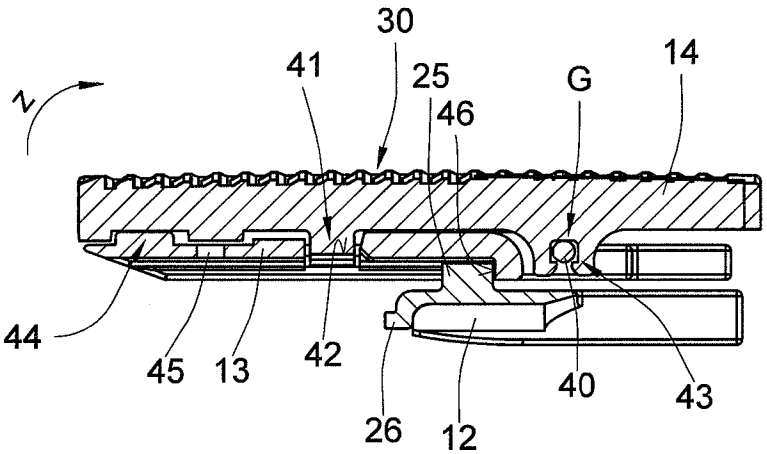
FIG. 10 is a section along line X-X in FIG. 9.

The blade holder in FIG. 5 is in the safety position. The blade 47 shown only in outline in FIG. 5 is supported in the housing 11 in such a way that the cutting edge of the blade 47 is inaccessible to the user as a result of being covered by the side flaps 15 and/or 16. When the assembly comprised of the actuator 14, the blade holder 13, and the blade 47 is moved in direction $x_1$, the entrainment face 46 of the blade holder 13 engages the entrainment pin 25 and thereby moves the spring slide 12 in the direction $x_1$. This action tensions the spring 35. Movement of the actuator 14 in the direction $x_1$ is possible only up until the entrainment pin 25 strikes the front end 33 of the slot 23. The blade holder 13 is then located in the front cutting position in which the blade 47 projects by the maximum amount from a front opening 48 of the housing 11 as shown in FIGS. 7 and 8.

When the user releases the actuator 14, the spring slide 12 is pulled in the direction $x_2$ by the spring 35, while at the same time the blade holder 13 and the actuator 14 are also moved in the direction $x_2$ by the entrainment pin 25 and the entrainment face 46.

The housing 11 comprises a cap, not shown, that can close or reveal a rear opening 49 of the housing 11. In order to change the blade, the cap is opened, and the assembly unit comprising the blade holder 13, the actuator 14, and blade 47 are pulled back out of the rear opening 49 of the housing 11.

At the point where supporting arms 41 are no longer engaged under the side flaps 15 and 16, the actuator 14 can be pivoted about the pivot point a away from the blade holder 13 in pivot direction $z_1$ into the release position, thereby allowing the blade 47 to be removed from the blade seat 29 and a new blade 47 to be inserted into the blade seat 29. The actuator 14 is then pivoted back into the retaining position, and the assembly unit consisting of the blade 47, the blade holder 13, and the actuator 14 is pushed back into the housing 11. The unillustrated closure is then closed. The knife is then once again functionally ready for cutting.

The invention claimed is:

1. A knife comprising:

a housing having a front end and a rear end and extending longitudinally therebetween;

a longitudinally shiftable actuator;

a blade holder carrying a blade movable longitudinally on the housing by the actuator between at least one safety rear-end position and at least one cutting front-end position, the blade on the blade holder being inside the housing in the safety rear-end position and projecting from the housing in the cutting front-end position;

a spring attached to the housing and operatively engaged to a first entrainment formation, the spring biasing the blade holder into one of the end positions; and a second entrainment formation is operatively engaged with the blade holder or the longitudinally shiftable actuator, the second entrainment formation being releasably engageable with the first entrainment formation such that the first entrainment formation is moved by the second entrainment formation, the blade holder being movable longitudinally from the safety rear-end position, with disengagement of the first and second entrainment formations, and out of the rear end of the housing for separation of the blade from the holder.

2. The knife according to claim 1, wherein the blade holder is urged by the spring into the safety rear-end position.

3. The knife according to claim 1, further comprising:

a slide provided with the first entrainment formation and movable in a guide on the housing between a rear position and a front position.

4. The knife according to claim 3, wherein the guide comprises a first guide associated with the housing and second guide associated with the slide.

5. The knife according to claim 4, wherein the second guide is formed by the first entrainment formation.

6. The knife according to claim 1, wherein the blade is retained between a supporting face of the blade holder and a supporting face of a retaining element.

7. The knife according to claim 6, further comprising:

a pivot connecting the retaining element with the blade holder.

8. The knife according to claim 6, wherein the housing forms a groove through which the retaining element passes.

9. The knife according to claim 8, wherein the retaining element has at least one arm that grips under side flaps of the housing defining the groove.

10. The knife according to claim 6, wherein the retaining element forms the actuator.

* * * * *